US009552690B2

(12) United States Patent
Meyer

(10) Patent No.: US 9,552,690 B2
(45) Date of Patent: Jan. 24, 2017

(54) SYSTEM AND METHOD FOR DETERMINING THE VOLATILITY OF A GAME BASED ON ONE OR MORE EXTERNAL DATA FEEDS

(71) Applicant: IGT, Reno, NV (US)

(72) Inventor: Adam M. Meyer, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/787,592

(22) Filed: Mar. 6, 2013

(65) Prior Publication Data

US 2014/0256408 A1 Sep. 11, 2014

(51) Int. Cl.
*G07F 17/32* (2006.01)

(52) U.S. Cl.
CPC ..... *G07F 17/3227* (2013.01); *G07F 17/323* (2013.01); *G07F 17/326* (2013.01)

(58) Field of Classification Search
CPC ..... A63F 9/24; G07F 17/32; G07F 17/3227; G07F 17/3267; G07F 17/3255; G07F 37/3237
See application file for complete search history.

(56) References Cited

U.S. PATENT DOCUMENTS

| | | | |
|---|---|---|---|
| 4,157,829 | A | 6/1979 | Alexoff et al. |
| 4,277,064 | A | 7/1981 | Newman |
| 4,448,419 | A | 5/1984 | Telnaes |
| 4,494,197 | A | 1/1985 | Troy et al. |
| 4,499,551 | A | 2/1985 | Frank |
| 4,527,798 | A | 7/1985 | Siekierski et al. |
| 4,582,324 | A | 4/1986 | Koza et al. |
| 4,624,459 | A | 11/1986 | Kaufman et al. |
| 4,652,998 | A | 3/1987 | Koza et al. |
| 4,669,730 | A | 6/1987 | Small et al. |
| 4,679,143 | A | 7/1987 | Hagiwara |
| 4,689,742 | A | 8/1987 | Troy et al. |
| 4,694,412 | A | 9/1987 | Domenik et al. |

(Continued)

FOREIGN PATENT DOCUMENTS

| | | |
|---|---|---|
| EP | 0 829 834 | 3/1998 |
| WO | WO 2004/077234 | 9/2004 |

(Continued)

*Primary Examiner* — James S McClellan
*Assistant Examiner* — Kevin Carter
(74) *Attorney, Agent, or Firm* — Neal, Gerber & Eisenberg LLP

(57) ABSTRACT

Various embodiments of the present disclosure provide a system and method for determining the volatility of a game based on one or more external data feeds. Generally, the system is configured to communicate with and collect data from one or more external data feeds, use the collected data to determine volatility data representing the volatility of a game, and provide one or more plays of the game having the volatility represented by the volatility data. In various embodiments, the system includes a volatility determination system including a data accumulator, an external feed data analyzer, and a metric data analyzer; and a gaming system. The volatility determination system collects the data from the external data feeds and uses the collected data to determine the volatility data representing the volatility of the game, and the gaming system provides a play of the game having the volatility represented by the determined volatility data.

22 Claims, 8 Drawing Sheets

(56) References Cited

U.S. PATENT DOCUMENTS 4,711,451 A 12/1987 Pajak et al.
4,713,787 A 12/1987 Rapp
4,791,594 A 12/1988 Harney et al.
4,817,951 A 4/1989 Crouch et al.
4,842,278 A 6/1989 Marcowicz et al.
4,982,337 A 1/1991 Burr et al.
5,042,809 A 8/1991 Richardson et al.
5,092,598 A 3/1992 Kamille
5,100,139 A 3/1992 Di Bella
5,158,293 A 10/1992 Mullins
5,199,710 A 4/1993 Lamle
5,251,165 A 10/1993 James
5,258,936 A 11/1993 Gallup et al.
5,265,874 A 11/1993 Dickinson et al.
5,282,620 A 2/1994 Keesee et al.
5,324,035 A 6/1994 Morris et al.
5,327,365 A 7/1994 Fujisaki et al.
5,407,199 A 4/1995 Gumina et al.
5,416,783 A 5/1995 Broseghini et al.
5,463,689 A 10/1995 Schutte et al.
5,511,784 A 4/1996 Furry et al.
5,562,284 A 10/1996 Stevens
5,586,937 A 12/1996 Menashe
5,588,913 A 12/1996 Hecht
5,602,845 A 2/1997 Wahl
5,628,684 A 5/1997 Bouedec et al.
5,779,545 A 7/1998 Berg et al.
5,871,398 A 2/1999 Schneier et al.
5,871,400 A 2/1999 Yfantis et al.
5,910,956 A 6/1999 Guthrie et al.
5,944,606 A 8/1999 Gerow et al.
5,949,042 A 9/1999 Dietz et al.
5,966,313 A 10/1999 Sakamoto et al.
5,967,893 A 10/1999 Lawrence et al.
6,017,032 A 1/2000 Grippo et al.
6,024,640 A 2/2000 Walker et al.
6,053,813 A 4/2000 Mathis
6,062,981 A 5/2000 Luciano
6,079,711 A 6/2000 Wei et al.
6,099,408 A 8/2000 Schneier et al.
6,113,492 A 9/2000 Walker et al.
6,117,009 A 9/2000 Yoseloff
6,159,096 A 12/2000 Yoseloff
6,183,361 B1 2/2001 Cummings et al.
6,193,607 B1 2/2001 Kay
6,210,275 B1 4/2001 Olsen
6,210,276 B1 4/2001 Mullins
6,220,961 B1 4/2001 Keane et al.
6,238,288 B1 5/2001 Walker et al.
6,241,606 B1 6/2001 Riendeau et al.
6,250,685 B1 6/2001 Walker et al.
6,254,480 B1 7/2001 Zach
6,254,483 B1 * 7/2001 Acres ..... 463/26
6,272,223 B1 8/2001 Carlson
6,290,603 B1 9/2001 Luciano, Jr.
6,309,298 B1 10/2001 Gerow
6,311,976 B1 11/2001 Yoseloff et al.
6,331,143 B1 12/2001 Yoseloff
6,358,151 B1 3/2002 Enzminger et al.
6,368,218 B2 4/2002 Angell, Jr.
6,402,614 B1 6/2002 Schneier et al.
6,419,583 B1 7/2002 Crumby et al.
6,428,413 B1 8/2002 Carlson
6,443,837 B1 9/2002 Jaffe et al.
6,443,838 B1 9/2002 Jaimet
6,447,395 B1 9/2002 Stevens
6,468,156 B1 10/2002 Hughs-Baird et al.
6,471,591 B1 10/2002 Crumby
6,502,116 B1 12/2002 Kelly et al.
6,524,184 B1 2/2003 Lind et al.
6,533,664 B1 3/2003 Crumby
6,537,150 B1 3/2003 Luciano et al.
6,569,013 B1 * 5/2003 Taylor ..... 463/13
6,569,016 B1 5/2003 Baerlocher
6,645,077 B2 * 11/2003 Rowe ..... 463/42
6,656,044 B1 12/2003 Lewis
6,666,766 B2 12/2003 Baerlocher et al.
6,678,707 B1 1/2004 Butler
6,688,977 B1 2/2004 Baerlocher et al.
6,695,700 B2 2/2004 Walker et al.
6,712,693 B1 3/2004 Hettinger
6,728,740 B2 4/2004 Kelly et al.
6,729,961 B1 5/2004 Millerschone
6,746,016 B2 6/2004 Perrie et al.
6,749,500 B1 6/2004 Nelson et al.
6,776,711 B1 8/2004 Baerlocher
6,780,110 B2 8/2004 Baerlocher et al.
6,790,143 B2 9/2004 Crumby
6,792,438 B1 9/2004 Wells et al.
6,793,578 B2 9/2004 Luccesi et al.
6,796,901 B2 9/2004 Baerlocher
6,796,902 B2 9/2004 Baerlocher et al.
6,800,026 B2 10/2004 Cannon
6,802,778 B1 10/2004 Lemay et al.
6,829,628 B2 12/2004 Kim
6,857,961 B2 2/2005 Soltys et al.
6,866,584 B2 3/2005 Michaelson
6,910,962 B2 6/2005 Marks et al.
6,964,612 B2 11/2005 Soltys et al.
6,966,834 B1 11/2005 Johnson
6,988,946 B2 1/2006 Michaelson et al.
7,001,278 B2 2/2006 Maya et al.
7,011,309 B2 3/2006 Soltys et al.
7,082,449 B2 7/2006 Rarick
7,136,889 B1 11/2006 Schreck
7,160,190 B2 1/2007 Baerlocher et al.
7,169,044 B2 1/2007 Baerlocher et al.
7,170,997 B2 1/2007 Petersen et al.
7,192,348 B2 3/2007 Brosnan et al.
7,198,569 B2 4/2007 Wolf et al.
7,201,657 B2 4/2007 Baerlocher et al.
7,203,841 B2 4/2007 Jackson et al.
7,222,852 B2 5/2007 Soltys et al.
7,235,009 B2 6/2007 Baerlocher
7,291,069 B2 11/2007 Michaelson et al.
7,316,613 B2 1/2008 Luccesi et al.
7,316,615 B2 1/2008 Soltys et al.
7,329,183 B2 2/2008 Michaelson et al.
7,331,865 B2 2/2008 Baerlocher et al.
7,341,513 B2 3/2008 Cuddy et al.
7,357,713 B2 4/2008 Marks et al.
7,371,166 B1 5/2008 Webb et al.
7,379,955 B1 5/2008 Kuehnel et al.
7,387,568 B2 6/2008 Millerschone
7,390,256 B2 6/2008 Soltys et al.
7,399,227 B2 7/2008 Michaelson et al.
7,412,468 B2 8/2008 Butler
7,448,626 B2 11/2008 Fleckenstein
7,452,272 B2 11/2008 Walker et al.
7,470,182 B2 12/2008 Martinek et al.
7,473,176 B2 1/2009 Michaelson
7,479,062 B2 1/2009 Michaelson
7,481,709 B2 1/2009 Bussick et al.
7,563,167 B2 7/2009 Walker et al.
7,588,496 B2 9/2009 Van Asdale
7,727,061 B2 6/2010 Taylor
7,740,534 B2 6/2010 Walker et al.
7,771,274 B2 8/2010 Walker et al.
7,828,648 B2 11/2010 Jackson
7,862,423 B2 1/2011 Walker et al.
8,002,621 B2 8/2011 Mattice et al.
8,016,662 B1 9/2011 Hamman et al.
8,021,222 B2 9/2011 Walker et al.
8,226,467 B2 7/2012 Weber et al.
2002/0039917 A1 4/2002 Armstrong et al.
2002/0040347 A1 4/2002 Murakami et al.
2002/0072404 A1 6/2002 Gerow
2002/0082070 A1 6/2002 Macke et al.
2002/0098882 A1 7/2002 Lind et al.
2002/0111214 A1 8/2002 Lind et al.
2002/0113369 A1 8/2002 Weingardt
2002/0169018 A1 11/2002 Schneier et al.
2003/0130029 A1 7/2003 Crumby
2003/0193136 A1 10/2003 Walker et al.

(56) References Cited

U.S. PATENT DOCUMENTS

| | | | | |
|---|---|---|---|---|
| 2004/0002376 | A1 | 1/2004 | Swift et al. | |
| 2004/0102242 | A1 | 5/2004 | Poelmann | |
| 2004/0116174 | A1 | 6/2004 | Baerlocher et al. | |
| 2004/0152507 | A1 | 8/2004 | Baerlocher et al. | |
| 2004/0166921 | A1 | 8/2004 | Michaelson | |
| 2004/0166923 | A1 | 8/2004 | Michaelson et al. | |
| 2004/0176167 | A1 | 9/2004 | Michaelson et al. | |
| 2004/0235559 | A1 | 11/2004 | Brosnan et al. | |
| 2004/0259629 | A1 | 12/2004 | Michaelson et al. | |
| 2005/0137012 | A1 | 6/2005 | Michaelson | |
| 2005/0143170 | A1 | 6/2005 | Maya et al. | |
| 2005/0208992 | A1 | 9/2005 | Randall | |
| 2006/0025210 | A1 | 2/2006 | Johnson | |
| 2006/0030387 | A1 | 2/2006 | Jackson | |
| 2006/0073874 | A1 | 4/2006 | Cregan et al. | |
| 2006/0094509 | A1 | 5/2006 | Michaelson et al. | |
| 2006/0252515 | A1 | 11/2006 | Walker et al. | |
| 2007/0004508 | A1 | 1/2007 | Walker et al. | |
| 2007/0077981 | A1* | 4/2007 | Hungate et al. | 463/16 |
| 2007/0149270 | A1 | 6/2007 | Baerlocher et al. | |
| 2007/0155464 | A1 | 7/2007 | Baerlocher et al. | |
| 2007/0155480 | A1 | 7/2007 | Brosnan et al. | |
| 2008/0026824 | A1 | 1/2008 | Muir | |
| 2008/0045302 | A1 | 2/2008 | Low | |
| 2008/0051169 | A1 | 2/2008 | Michaelson et al. | |
| 2008/0076527 | A1 | 3/2008 | Low et al. | |
| 2008/0090655 | A1 | 4/2008 | Marks et al. | |
| 2008/0102931 | A1 | 5/2008 | Marks et al. | |
| 2008/0113763 | A1 | 5/2008 | Michaelson et al. | |
| 2008/0200242 | A1 | 8/2008 | Ginsberg et al. | |
| 2008/0234021 | A1 | 9/2008 | Palmer et al. | |
| 2008/0242398 | A1* | 10/2008 | Harris et al. | 463/25 |
| 2008/0263117 | A1 | 10/2008 | Rose et al. | |
| 2008/0268935 | A1 | 10/2008 | Acres | |
| 2009/0042652 | A1 | 2/2009 | Baerlocher et al. | |
| 2009/0088239 | A1 | 4/2009 | Iddings et al. | |
| 2009/0124316 | A1 | 5/2009 | Baerlocher et al. | |
| 2010/0002877 | A1 | 1/2010 | Zhang | |
| 2010/0120497 | A1 | 5/2010 | Weber et al. | |
| 2010/0120506 | A1 | 5/2010 | Davis et al. | |
| 2010/0124971 | A1 | 5/2010 | Baerlocher et al. | |
| 2010/0210338 | A1 | 8/2010 | Taylor | |
| 2011/0034236 | A1 | 2/2011 | Jackson | |
| 2011/0111826 | A1 | 5/2011 | Baerlocher et al. | |
| 2011/0118010 | A1 | 5/2011 | Brune | |
| 2012/0282995 | A1* | 11/2012 | Allen et al. | 463/22 |
| 2013/0274009 | A1* | 10/2013 | Bryson et al. | 463/29 |
| 2014/0094274 | A1* | 4/2014 | Guinn G07F 17/326 | 463/25 |

FOREIGN PATENT DOCUMENTS

| | | |
|---|---|---|
| WO | WO 2004/077238 | 9/2004 |
| WO | WO 2004/081714 | 9/2004 |
| WO | WO 2006/007481 | 1/2006 |

* cited by examiner

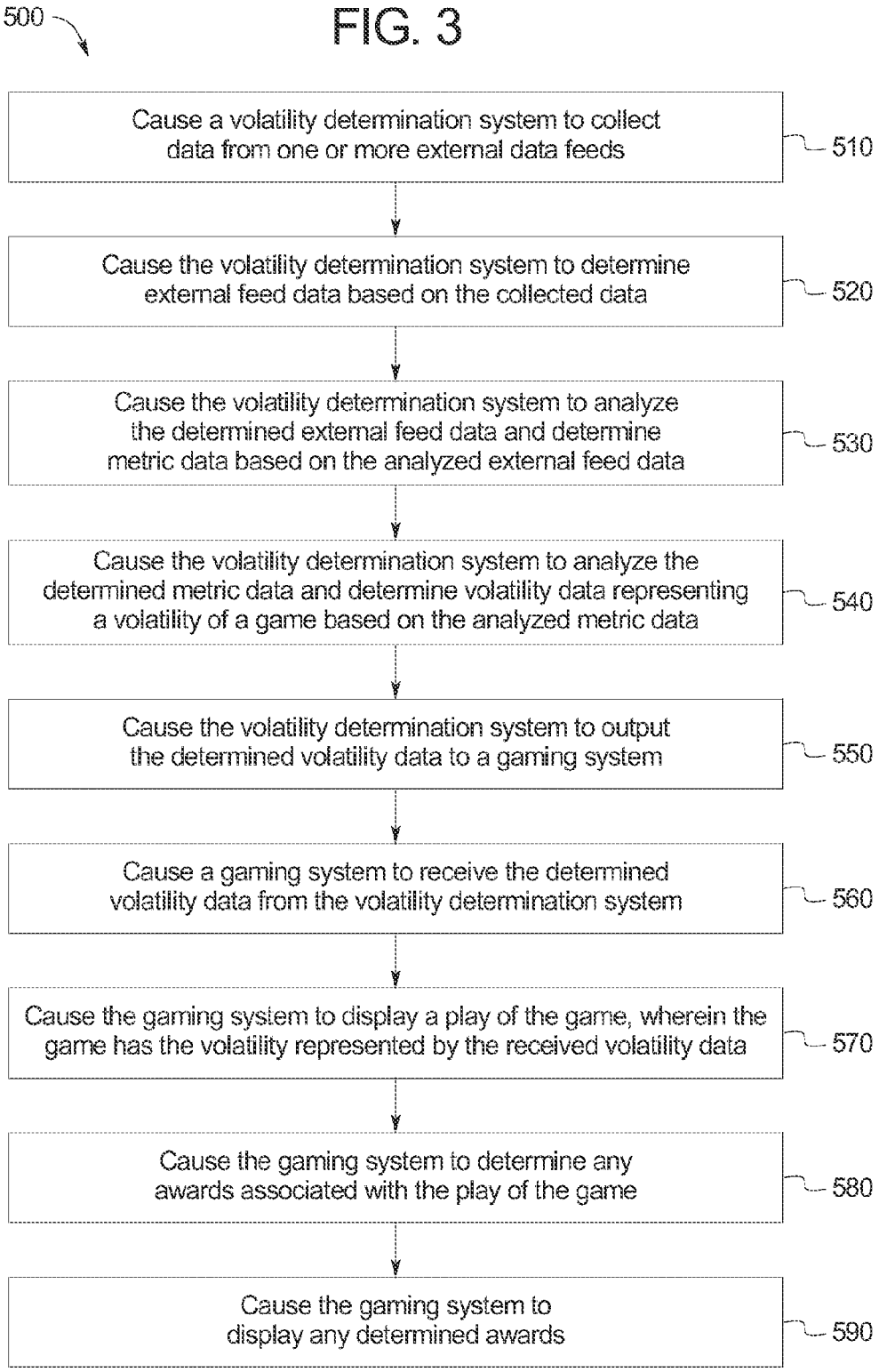
500
FIG. 3
Cause a volatility determination system to collect data from one or more external data feeds
510
Cause the volatility determination system to determine external feed data based on the collected data
520
Cause the volatility determination system to analyze the determined external feed data and determine metric data based on the analyzed external feed data
530
Cause the volatility determination system to analyze the determined metric data and determine volatility data representing a volatility of a game based on the analyzed metric data
540
Cause the volatility determination system to output the determined volatility data to a gaming system
550
Cause a gaming system to receive the determined volatility data from the volatility determination system
560
Cause the gaming system to display a play of the game, wherein the game has the volatility represented by the received volatility data
570
Cause the gaming system to determine any awards associated with the play of the game
580
Cause the gaming system to display any determined awards
590

SYSTEM AND METHOD FOR DETERMINING THE VOLATILITY OF A GAME BASED ON ONE OR MORE EXTERNAL DATA FEEDS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming systems, an amount of a wager placed on a primary game by a player may vary. For instance, a gaming system may enable a player to wager a minimum quantity of credits, such as one credit (where one credit represents a unit of monetary currency such as one penny, nickel, dime, quarter, or dollar or a unit of virtual currency such as one virtual coin, virtual casino chip, player point, loyalty point, or cross-game point), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Internet-based social networks, such as Facebook, Twitter, MySpace, and Pinterest, and live data feeds, such as Rich Site Summary (RSS) feeds, have become immensely popular in recent years, and are fixtures in many of their users' daily lives. These ubiquitous social networks and live data feeds enable users to keep up to date on trending stories and breaking news in real time and to share this information with others. Various embodiments of the present disclosure are directed to a system and method that harness the popularity of social networks and/or live data feeds to determine the volatility of a game. More specifically, the system of the present disclosure is configured to collect data from the external data feeds and use that collected data to set the volatility of the game such that game play is tailored to current trends and events, which provides a more immersive and exciting game play experience.

In one example, the system of the present disclosure is configured to operate a game having a theme and a plurality of winning outcomes associated with different topics related to the theme. In this example, the game is associated with a total amount of award credits. The system is configured to collect data from a social network such as Twitter and allocate the award credits to the different winning outcomes (i.e., create a paytable) based on how much of the collected data is associated with the respective topics associated with the winning outcomes. The system allocates relatively more credits to winning outcomes associated with relatively more popular topics (i.e., that have more mentions within the collected data) than to winning outcomes associated with relatively less popular topics (i.e., that have relatively fewer mentions within the collected data).

Generally, the system is configured to communicate with and collect data from one or more external data feeds, use the collected data to determine volatility data representing the volatility of a game, and provide one or more plays of the game having the volatility represented by the determined volatility data. More specifically, in various embodiments, the system includes: (a) a volatility determination system that includes a data accumulator, an external feed data analyzer, and a metric data analyzer; and (b) a gaming system. The volatility determination system is configured to collect the data from the one or more external data feeds and use the collected data to determine the volatility data representing the volatility of the game, and the gaming system is configured to provide one or more plays of the game having the volatility represented by the determined volatility data.

In operation of one embodiment of the system, the data accumulator communicates with and collects data from the one or more external data feeds. The data accumulator analyzes the collected data to determine which of the collected data is relevant for determining the volatility of the game, and determines external feed data based on the relevant collected data. The data accumulator then outputs the determined external feed data to the external feed data analyzer. The external feed data analyzer receives the determined external feed data from the data accumulator and analyzes the received external feed data to determine metric data based on the analyzed external feed data. The format of the metric data differs based on the particular application, but generally represents how popular each of a plurality of keywords or search terms is within the determined external feed data relative to the other keywords or search terms. Generally, the external feed data analyzer determines the metric data by analyzing the determined external feed data for such keywords or search terms (and/or related keywords or search terms) and accumulating data regarding the use of those keywords or search terms within the determined external feed data. The metric data analyzer outputs the determined metric data to the metric data analyzer.

The metric data analyzer receives the determined metric data, analyzes the received metric data, determines volatility data representing the volatility of the game based on the analyzed metric data, and outputs the determined volatility data to the gaming system. The gaming system receives the determined volatility data from the metric data analyzer, displays a play of the game having the volatility represented by the determined volatility data, determines any awards associated with the play of the game, and displays any determined awards.

It should thus be appreciated that the system and method of the present disclosure incorporate new and different ways of determining the volatility of a game based on current events and trending, popular topics, thereby increasing player enjoyment, entertainment, and excitement.

Additional features and advantages are described herein, and will be apparent from, the following Detailed Description and the Figures.

BRIEF DESCRIPTION OF THE FIGURES

FIG. 3 is a flowchart illustrating an example method of operating another example embodiment of the system of the present disclosure.

DETAILED DESCRIPTION

Determining the Volatility of a Game Based on One or More External Data Feeds Various embodiments of the present disclosure are directed to a system and method for determining the volatility of a game based on one or more external data feeds. More specifically, the system of the present disclosure is configured to collect data from the external data feeds and use that collected data to set the volatility of the game such that game play is tailored to current trends and events, which provides a more immersive and exciting game play experience. In various embodiments, the system does so without modifying an average expected payback percentage of the game.

Figure 1:
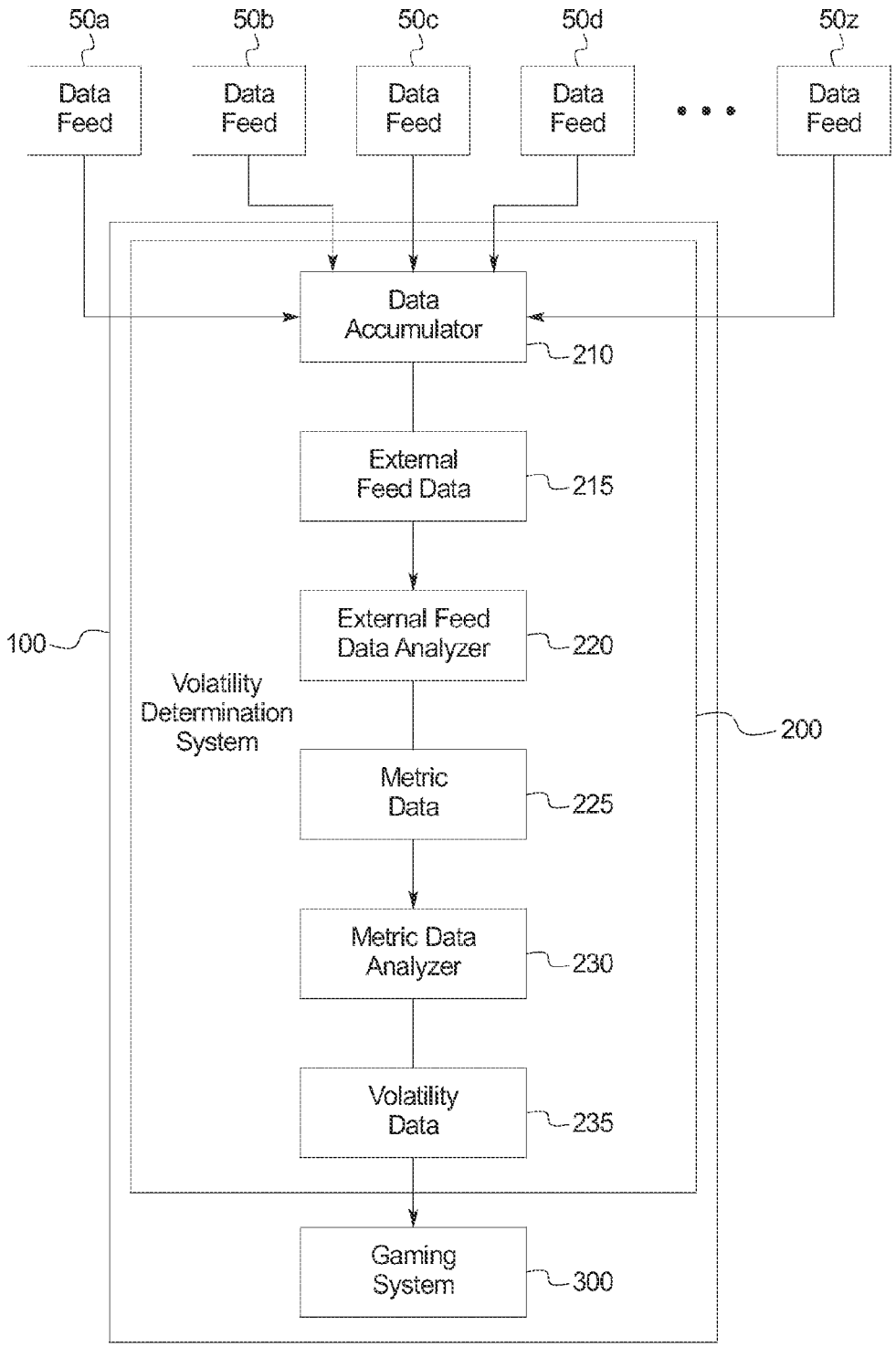
FIG. 1 is a block diagram of one example embodiment of the system of the present disclosure.

FIG. 1 illustrates a block diagram of one example embodiment of the system of the present disclosure, which is generally indicated by numeral 100. The system 100 is configured to communicate with and collect data from a plurality of external data feeds 50*a*, 50*b*, 50*c*, 50*d*, . . . 50*z*; use the collected data to determine volatility data representing the volatility of a game; and provide one or more plays of the game having the volatility represented by the determined volatility data. More specifically, the system 100 includes: (a) a volatility determination system 200 that includes a data accumulator 210, an external feed data analyzer 220, and a metric data analyzer 230; and (b) a gaming system 300, which is described in detail below. The volatility determination system 200 is configured to collect the data from the external data feeds 50*a*, 50*b*, 50*c*, 50*d*, . . . 50*z* and use the collected data to determine volatility data representing the volatility of the game, and the gaming system 300 is configured to provide one or more plays of the game having the volatility represented by the determined volatility data.

While the volatility determination system is configured to collect data from each of a plurality of external data feeds in this example, it should be appreciated that, in other embodiments, the volatility determination system is configured to collect data from only one external data feed or any suitable number of external data feeds.

In operation of this illustrated example of the system 100, the data accumulator 210 communicates with and collects data from the external data feeds 50*a*, 50*b*, 50*c*, 50*d*, . . . 50*z*. The data accumulator analyzes the collected data to determine which of the collected data is relevant for determining the volatility of the game, and determines external feed data 215 based on the relevant collected data. It should be appreciated that the relevant collected data includes the collected data that will be used to determine the volatility data representing the volatility of the game. In certain embodiments, the determined external feed data 215 is a single feed of the relevant collected data. The data accumulator 210 then outputs the determined external feed data 215 to the external feed data analyzer 220.

In certain embodiments, one or more of the external data feeds are not controlled by the system and, therefore, are not affected by any functionality of the system, such as the status or properties of any part of the system. For instance, in certain such embodiments, the external data feeds are not affected by game play on the gaming system. In various embodiments, the volatility determination system is configured to communicate with the external data feeds and the gaming system via a data network such as an internet, a local area network (LAN), or a wide area network (WAN). It should be appreciated that the volatility determination system may communicate with different external data feeds in different manners.

It should be appreciated that the volatility determination system may collect data from one or more external data feeds over any suitable data collection period, such as (but not limited to): (a) every minute, (b) every hour, (c) every day, (d) every week, (e) a rolling time period including the previous minute, (f) a rolling time period including the previous hour, (g) a rolling time period including the previous day, (h) a rolling time period including the previous week, and/or (i) a period of time since a prior win.

It should be appreciated that the volatility determination system collects and stores data from the one or more external data feeds during the data collection period in any of a variety of manners. In certain embodiments, the volatility determination system actively polls the one or more external data feeds to collect data. When the one or more external data feeds are polled, the one or more external data feeds transmit data to the volatility determination system, which stores that data in a database. In one embodiment, the volatility determination system polls the one or more external data feeds at predetermined intervals (such as every second, every five seconds, every ten seconds, every minute, every fifteen minutes, or every hour) during the data collection period. In another embodiment, the volatility determination system polls the one or more external data feeds at designated points in time (e.g., upon expiration of the data collection period) during the data collection period. In another embodiment, the volatility determination system polls the one or more external data feeds upon the occurrence of one or more designated events (e.g., the occurrence of an event in real time that is associated with the theme of the game) that occur during the data collection period. It should be appreciated that the volatility determination system may poll the one or more external data feeds at the same time or at different times (such as sequentially).

In other embodiments, the volatility determination system passively receives data from the one or more external data feeds in any of a variety of manners. That is, in these embodiments, data is pushed to the volatility determination system from the one or more external data feeds. When data is pushed from the one or more external data feeds to the volatility determination system, the volatility determination system receives and stores that data in the database. In one embodiment, the one or more external data feeds push data to the volatility determination system at predetermined intervals (such as every second, every five seconds, every ten seconds, every minute, every fifteen minutes, or every hour) during the data collection period. In another embodiment, the one or more external data feeds push data to the volatility determination system at designated points in time (e.g., upon expiration of the data collection period) during the data collection period. In another embodiment, the one or more external data feeds push data to the volatility determination system upon the occurrence of one or more designated events (e.g., the occurrence of an event in real time that is associated with the theme of the game) that occur during the data collection period. It should be appreciated that the volatility determination system may poll the one or more external data feeds at the same time or at different times (such as sequentially). It should also be appreciated that the volatility determination system may employ any of the above active and/or passive manners of data collection alone or in combination with one another.

It should also be appreciated that the external data feeds may be any suitable sources from which data may be collected, such as (but not limited to): (a) social networking websites (such as Twitter, Facebook, MySpace, and/or Pinterest); (b) news services (such as Reuters or AP Wire); (c) gaming establishment data collection sources or databases (such as player tracking systems; ticket sales data; EGM data collection systems or databases (such as those that track wins and losses, coin-in and coin-out, rate of play, and the like)); (d) search engines (such as Google or Yahoo); (e) databases of sporting event scores (such as ESPN scoreboards); (f) weather databases (such as www.weather.com); (g) RSS feeds; (h) the stock market; (i) the futures exchange; (j) the foreign exchange market; and/or (k) message board type websites (such as Reddit). It should further be appreciated that the data collected from the external data feeds may be any suitable data, such as (but not limited to): (a) Twitter hashtags, Facebook search queries and/or results, and/or MySpace search queries and/or results; (b) numbers of page views of one or more news articles; (c) numbers of articles related to specific topics; (d) player tracking data collected during game play at a gaming establishment; (e) Google or Yahoo search queries and/or results; (f) quantities of points scored during a sporting event; (g) temperatures at one or more cities; (h) quantities of "likes" for one or more Facebook posts or pages; (i) numbers of "fans" of one or more Facebook posts or pages; (j) numbers of "retweets" of a Twitter post; (k) quantities of "pins" on a Pinterest board; (l) quantities of Twitter followers; (m) quantities of "likes" or "dislikes" and/or "upvotes" or "downvotes"; (n) weather events; (o) prop bet outcomes; (p) prop bet odds; (q) on-floor pots (such as during poker tournaments); and/or (r) point spreads.

It should further be appreciated that the volatility determination system determines which of the collected data is relevant for determining the volatility of the game in any suitable manner. In one example, the gaming system or the game operated by the gaming system is associated with a theme, such as a professional sport, a movie, a television show, a cartoon, a game show, a video game, music, a social network or internet "meme," a historic event, and/or a political figure. In this example, the volatility determination system determines that the collected data associated with that theme is relevant data. In another example, the game includes a plurality of winning outcomes, each of which is associated with a distinct component, such as a distinct color, a distinct sports team, a distinct character in a movie or a television show, a distinct cartoon character, a distinct prize of a game show, a distinct political figure, a distinct "meme," a distinct historic event, a distinct character from a video game, and/or a distinct band or band member. In this example, the volatility determination system determines that the collected data associated with at least one of those distinct themes is relevant data.

The external feed data analyzer 220 receives the determined external feed data 215 from the data accumulator 210 and analyzes the received external feed data 215 to determine metric data 225 based on the analyzed external feed data 215. The format of the metric data 225 differs based on the particular application, but generally represents how popular each of a plurality of keywords or search terms is within the determined external feed data 215 relative to the other keywords or search terms. Generally, the external feed data analyzer 220 determines the metric data 225 by analyzing the determined external feed data 215 for such keywords or search terms (and/or related keywords or search terms) and accumulating data regarding the use of those keywords or search terms within the determined external feed data 215. For instance, the external feed data analyzer 220 determines the metric data 225 by, for each of a plurality of search terms, analyzing the determined external feed data 215 for the absolute number of hits of that search term, the number of hits of that search term per a quantity of words, the number of hits of that search term relative to the number of hits of the other search terms, the number of hits of terms related to or linked to that search term, the probability of occurrence of that search term, the rate of change of hits of that search term, and/or the favorability of that search term. The metric data analyzer 230 outputs the determined metric data 225 to the metric data analyzer 230.

The metric data analyzer 230 receives the determined metric data 225, analyzes the received metric data 225, determines volatility data 235 representing the volatility of the game based on the analyzed metric data 225, and outputs the determined volatility data 235 to the gaming system 300. The gaming system 300 receives the determined volatility data 235 from the metric data analyzer 230, displays a play of the game having the volatility represented by the received volatility data 235, determines any awards associated with the play of the game, and displays any determined awards.

It should be appreciated that, in various embodiments, the system indicates the volatility represented by the determined volatility data and/or the volatility data itself to the player. This informs the player that the volatility of the game changes based on historical and/or current events or trends. In one example, the gaming system displays the volatility to the player, such as by displaying one or more paytables to the player, by displaying a message to the player that the volatility has changed, by displaying how a previously-employed paytable is changing for one or more future plays, and/or by displaying the trending or popular topics causing the volatility change.

Figure 2A:
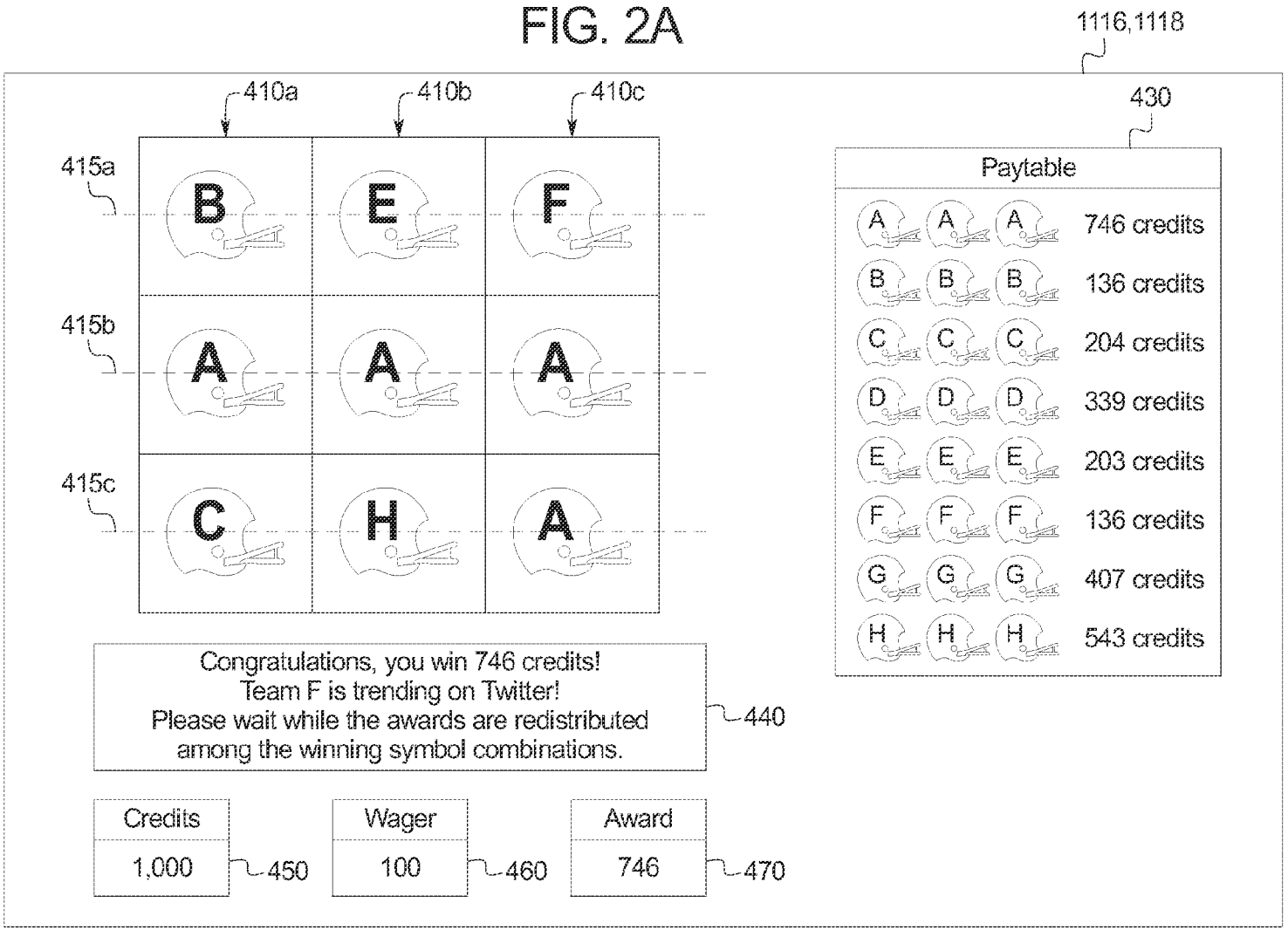
FIGS. 2A and 2B are screenshots of an example embodiment of the gaming system of the present disclosure.
Figure 2B:
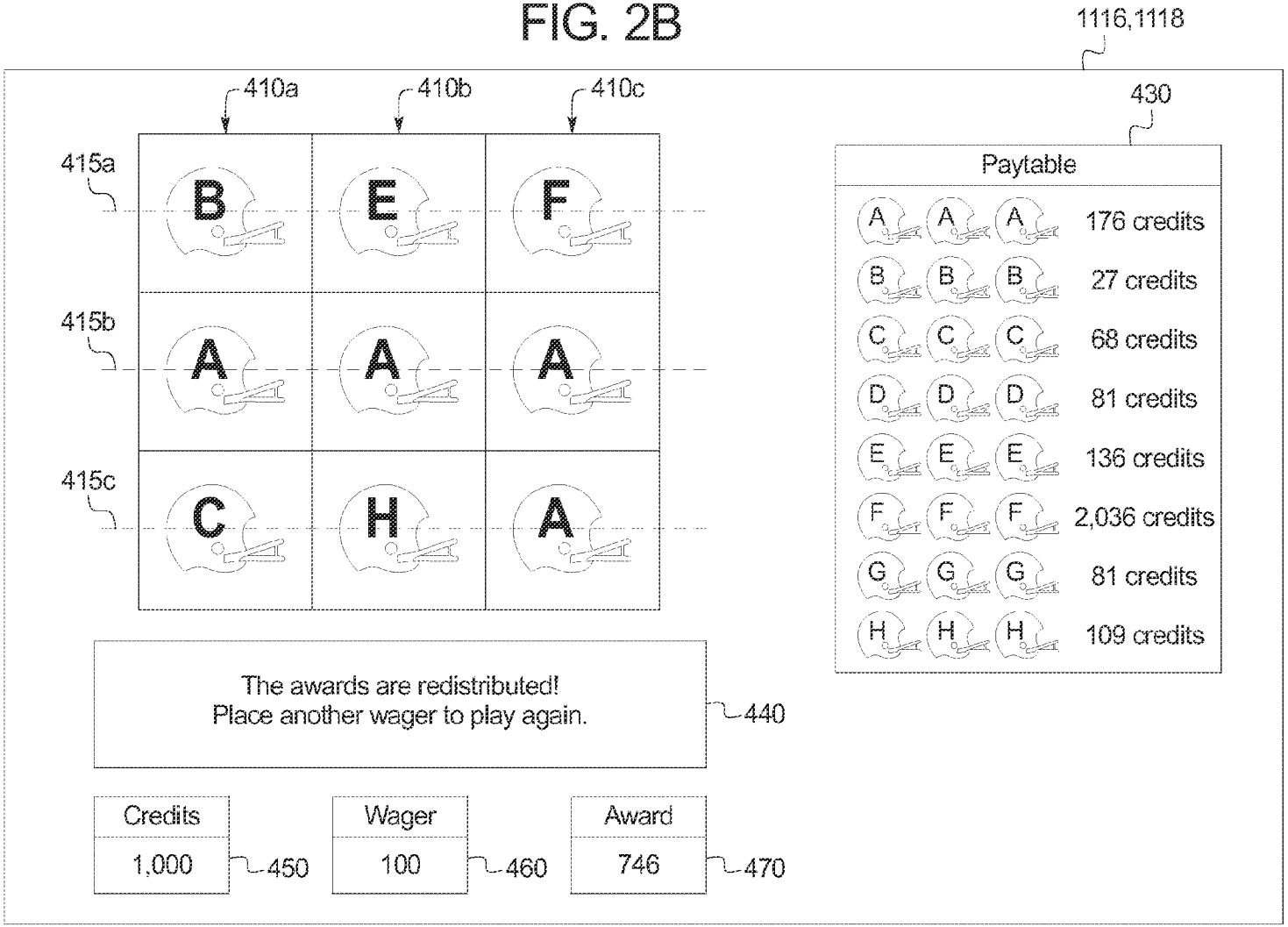

FIGS. 2A and 2B illustrate screen shots of one example embodiment of the gaming system of the present disclosure configured to operate a slot game having a football theme and a volatility determined by an example embodiment of the volatility determination system of the present disclosure. In this example, the slot game is associated with a plurality of symbols including helmets of eight different football teams: Team A, Team B, Team C, Team D, Team E, Team F, Team G, and Team H. The slot game is associated with, and the gaming system displays (such as on display device 1116 or 1118, described below) a plurality of adjacently arranged reels 410*a*, 410*b*, and 410*c*, each of which includes a plurality of the symbols, and a plurality of paylines 415*a*, 415*b*, and 415*c*, each of which is associated with each of the reels 410*a*, 410*b*, and 410*c*. The slot game is also associated with, and the gaming system displays, a paytable 430, which includes eight different winning symbol combinations and a credit award associated with each different winning symbol combination. Each of the eight different winning symbol combinations is associated with one of the eight different football teams. For instance, the winning symbol combination including Helmet A-Helmet A-Helmet A is associated with Team A; the winning symbol combination including Helmet B-Helmet B-Helmet B is associated with Team B; and so on.

The gaming system also displays a message box 440 that displays messages or indications before, during, or after play of the slot game, and a plurality of meters including: a credit meter 450 configured to display the player's current credit balance; a wager meter 460 configured to display the player's wager on the current play of the slot game; and an award meter 470 that displays any awards won for the current play of the slot game. While in this illustrated example the gaming system indicates any awards in the form of amounts of credits, it should be appreciated that such indications may alternatively or additionally be made in the form of amounts of currency.

FIG. 2A is a screen shot of the gaming system following a play of the slot game subject to a 100 credit wager placed by a player in which the winning symbol combination associated with Team A was generated and displayed along payline 415*b*, causing the gaming system to provide the player the award of 746 credits associated with that winning symbol combination. At this point in time, a data collection period ends, causing the gaming system to modify the volatility of the slot game for plays that occur during the next hour-long data collection period. Accordingly, the volatility determination system employs data collected from Twitter (described below) to determine volatility data representing the volatility of the slot game for plays that occur during the next hour. The gaming system displays the following message in message box 440: "CONGRATULATIONS, YOU WIN 746 CREDITS! TEAM F IS TRENDING ON TWITTER! PLEASE WAIT WHILE THE AWARDS ARE REDISTRIBUTED AMONG THE WINNING SYMBOL COMBINATIONS!"

As noted above, in this example, the volatility determination system communicates with Twitter (i.e., an external data feed), periodically collects data from Twitter over the course of each hour (in any of the manners described above), and uses the collected data to determine volatility data representing the volatility of the slot game for the following hour. For instance, the system collects data from Twitter from 1:00 A.M. to 2:00 A.M. and uses the collected data to determine the volatility data representing the volatility of the slot game for the time period of 2:00 A.M. to 3:00 A.M., collects data from Twitter from 2:00 A.M. to 3:00 A.M. and uses the collected data to determine the volatility data representing the volatility of the slot game for the time period of 3:00 A.M. to 4:00 A.M., and so on. In this example, the volatility determination system determines the volatility data for the slot game by creating a paytable associated with each possible wager on a play of the slot game. In other words, for each possible wager on a play of the slot game, the volatility determination system assigns a credit award to each of the winning symbol combinations to be provided if that winning symbol combination is generated and displayed for a play of the slot game subject to that wager.

In this example, the volatility determination system and, more specifically, the data accumulator of the volatility determination system, is configured to communicate with and collect data from Twitter. In this example, the collected data represents the Twitter hashtags used by a randomly determined subset of 5,000 (or any suitable number) of Twitter's users. Upon completion of (and/or during) each hour-long data collection period, the data accumulator analyzes the collected data to determine which of the collected data is relevant for determining the volatility of the slot game, and determines external feed data based on the relevant collected data. In this example, upon completion of the data collection period, the data accumulator analyzes the collected data to determine which of the hashtags used by the subset of 5,000 Twitter users during the data collection period are associated with the winning symbol combinations. More specifically, the data accumulator analyzes the collected data to identify usage of the hashtags #TeamA, #TeamB, #TeamC, #TeamD, #TeamE, #TeamF, #TeamG, and #TeamH, which are each associated with one of the winning symbol combinations. In another embodiment, the data accumulator analyzes the collected data to also identify the usage of hashtags related to the above hashtags (such as #QBTeamA, #RBTeamB, #WRTeamC, #MascotTeamD, and the like). Table 1 below includes a representative portion of the collected data of this example, and Table 2 below includes a representative portion of the external feed data of this example. It should be appreciated that the collected data and the external feed data may be stored and/or presented in any suitable format. The data accumulator outputs the determined external feed data representing the relevant collected data to the external feed data analyzer.

TABLE 1

| Example Collected Data | | | | | |
|---|---|---|---|---|---|
| Collected Data | | | | | |
| #TeamA, | #TeamZ, | #TeamB, | #TeamF, | #TeamF, | #TeamF, |
| #TeamM, | #TeamY, | #TeamZ, | #TeamF, | #TeamE, | #TeamW, |
| #TeamP, | #TeamF, | #TeamF, | #TeamG, | #TeamH, | #TeamY, |
| #TeamF, | #TeamD, | #TeamD, | #TeamE, | #TeamF, | #TeamA, |
| #TeamQ, | #TeamF, | #TeamH, | #TeamG, | #TeamE, . . . #TeamR | |

TABLE 2

| Example External Feed Data | | | | | |
|---|---|---|---|---|---|
| External Feed Data | | | | | |
| #TeamA, | #TeamB, | #TeamF, | #TeamF, | #TeamF, | #TeamF, |
| #TeamE, | #TeamF, | #TeamF, | #TeamG, | #TeamH, | #TeamF, |
| #TeamD, | #TeamD, | #TeamE, | #TeamF, | #TeamA, | #TeamF, |
| #TeamH, | #TeamG, . . . #TeamE | | | | |

The external feed data analyzer receives the determined external feed data, which in this example includes data representing the usage of the hashtags #TeamA, #TeamB, #TeamC, #TeamD, #TeamE, #TeamF, #TeamG, and #TeamH during the data collection period, from the data accumulator. The external feed data analyzer analyzes the received external feed data and determines metric data based on the analyzed external feed data. In this example, the determined metric data includes, for each hashtag #TeamA, #TeamB, #TeamC, #TeamD, #TeamE, #TeamF, #TeamG, and #TeamH: (a) the number of uses of that hashtag during the data collection period; and (b) the percentage of the total uses of #TeamA, #TeamB, #TeamC, #TeamD, #TeamE, #TeamF, #TeamG, and #TeamH that that hashtag represents. Table 3 below illustrates the determined metric data in this example, though it should be appreciated that the metric data may be stored and/or presented in any suitable format. After determining the metric data, the external feed data analyzer outputs the determined metric data to the metric data analyzer.

TABLE 3

Example Metric Data
Metric Data

| Winning Symbol Combination | Associated Hashtag | Number of Uses During the Data Collection Period | Percentage of Total Uses of #TeamA, #TeamB, #TeamC, #TeamD, #TeamE, #TeamF, #TeamG, and #TeamH |
|---|---|---|---|
| Team A | #TeamA | 650 | 6.5% |
| Team B | #TeamB | 100 | 1% |
| Team C | #TeamC | 250 | 1.5% |
| Team D | #TeamD | 300 | 3% |
| Team E | #TeamE | 500 | 5% |
| Team F | #TeamF | 7,500 | 75% |
| Team G | #TeamG | 300 | 3% |
| Team H | #TeamH | 400 | 4% |

It should be appreciated that the determined metric data shows that Team F was "trending" or popular among the 5,000 Twitter users relative to the other seven teams during the data collection period. For instance, Team F may have announced a significant free agent signing, been awarded the top draft pick in an upcoming collegiate draft, or won an important game during the data collection period. Thus, as generally noted above and as described in detail below, the volatility determination system allocates more of the available awards to Team F relative to the other teams to reflect Team F's popularity relative to the other teams during the data collection period.

The metric data analyzer receives the determined metric data, analyzes the received metric data, and determines volatility data representing the volatility of the slot game based on the analyzed metric data. As noted above, in this example, the metric data analyzer determines the volatility data of the slot game by creating a paytable associated with each possible wager on a play of the slot game. In other words, for each possible wager on a play of the slot game, the metric data analyzer assigns a credit award to each winning symbol combination to be provided if that winning symbol combination is generated and displayed for a play of the slot game subject to that wager.

To determine the award to assign to a given winning symbol combination for a given wager, in this example the metric data analyzer: (a) multiplies the average expected payback percentage of the slot game by an amount of that wager to determine the slot game's expected value, (b) multiplies the slot game's expected value by the percentage of uses of the hashtag associated with that winning symbol combination relative to the uses of all eight of the hashtags to determine a value of that hashtag, and (c) divides the determined value of the hashtag by the probability of that winning symbol combination occurring to determine the award to assign to that winning symbol combination. The metric data analyzer repeats these steps for each winning symbol combination to create the paytable associated with that wager. The metric data analyzer repeats this process for each additional possible wager until the metric data analyzer has created a paytable associated with each possible wager.

In this example, the slot game has an average expected payback percentage of 95% and possible wagers of 1 credit, 10 credits, and 100 credits. To create the paytable for the slot game associated with the 100 credit wager, the volatility determination system determines the award assigned to the winning symbol combination associated with Team A by: (a) multiplying the average expected payback percentage of 95% by the wager amount of 100 credits to determine the slot game's average expected value of 95 credits; (b) multiplying the slot game's average expected value of 95 credits by 6.5%, which is the percentage of uses of the #TeamA hashtag relative to the percentage of uses of all eight of the hashtags (i.e., the combined number of uses of #TeamA, #TeamB, #TeamC, #TeamD, #TeamE, #TeamF, #TeamG, and #TeamH), to determine the #TeamA hashtag's value of 6.175 credits; and (c) dividing the #TeamA hashtag's value of 6.175 credits by 3.5%, which is the probability that the winning symbol combination associated with Team A will occur, to determine the award of 176 credits (rounded down from 176.43 credits) to assign to the Team A winning outcome. The volatility determination system determines the awards to assign to each of the other winning symbol combinations in a similar manner. Table 4 below includes the volatility data including the determined awards assigned to each of the winning symbol combinations for the 100 credit wager. It should be appreciated that the volatility data may be stored and/or presented in any suitable format.

TABLE 4

Example Volatility Data of a Game Having an Average Expected Payback Percentage of 95%, a Wager of 100 Credits, and Winning Outcomes Having Identical Probabilities of Occurrence Volatility Data

| Winning Symbol Combination | Associated Hashtag | Percentage of Total Uses of #TeamA, #TeamB, #TeamC, #TeamD, #TeamE, #TeamF, #TeamG, and #TeamH | Hashtag Value (credits) | Probability of Occurrence of the Winning Symbol Combination | Assigned Award (credits) |
|---|---|---|---|---|---|
| Team A | #TeamA | 6.5% | 6.175 | 3.5% | 176 |
| Team B | #TeamB | 1% | 0.95 | 3.5% | 27 |
| Team C | #TeamC | 1.5% | 2.375 | 3.5% | 68 |
| Team D | #TeamD | 3% | 2.85 | 3.5% | 81 |
| Team E | #TeamE | 5% | 4.75 | 3.5% | 136 |
| Team F | #TeamF | 75% | 71.25 | 3.5% | 2,036 |
| Team G | #TeamG | 3% | 2.85 | 3.5% | 81 |
| Team H | #TeamH | 4% | 3.8 | 3.5% | 109 |

In this example, the metric data analyzer outputs the determined paytables (i.e., the determined volatility data in this example) to the gaming system 300. The gaming system employs the received paytables for plays of the primary wagering game that occur during the next hour-long data collection period. It should thus be appreciated that, in this example, winning symbol combinations associated with hashtags that are used more often (i.e., that are relatively more popular) are associated with higher awards than winning symbol combinations associated with hashtags that are used less often (i.e., that are relatively less popular) and, therefore, the volatility of the slot game depends upon the usage of the hashtags associated with the winning symbol combinations. In this example, the slot game (and the player's gaming experience) will change based on trending, popular hashtags.

FIG. 2B is a screen shot of the gaming system following the determination of the new volatility for the slot game. The gaming system updates paytable 430 to reflect the new awards associated with the winning symbol combinations determined by the volatility determination system and displays the following message in message box 440: "THE AWARDS ARE REDISTRIBUTED! PLACE ANOTHER WAGER TO PLAY AGAIN"

It should be appreciated that the system of the present disclosure may be employed when the probabilities of occurrence of at least two of the winning outcomes differ. For instance, Table 5 below includes the assigned awards for an example game identical to that described above in association with Table 4, but in which at least two of the winning symbol combinations have different probabilities of occurrence.

TABLE 5

Example Volatility Data of a Game Having an Average Expected Payback Percentage of 95%, a Wager of 100 Credits, and Winning Outcomes Having Different Probabilities of Occurrence Volatility Data

| Winning Symbol Combination | Associated Hashtag | Percentage of Total Uses of #TeamA, #TeamB, #TeamC, #TeamD, #TeamE, #TeamF, #TeamG, and #TeamH | Hashtag Value (credits) | Probability of Occurrence of the Winning Symbol Combination | Assigned Award (credits) |
|---|---|---|---|---|---|
| Team A | #TeamA | 6.5% | 6.175 | 1% | 618 |
| Team B | #TeamB | 1% | 0.95 | 5% | 19 |
| Team C | #TeamC | 1.5% | 2.375 | 2.5% | 95 |
| Team D | #TeamD | 3% | 2.85 | 3.5% | 81 |
| Team E | #TeamE | 5% | 4.75 | 4% | 119 |
| Team F | #TeamF | 75% | 71.25 | 6% | 1,188 |
| Team G | #TeamG | 3% | 2.85 | 2.5% | 114 |
| Team H | #TeamH | 4% | 3.8 | 3.5% | 109 |

In other embodiments, instead of or in addition to employing the collected data to determine the paytables (i.e., the volatility data) for a primary wagering game, the volatility determination system uses the collected data to determine which of a plurality of different bonus games to provide when a bonus triggering event occurs in association with play of the primary wagering game. In one example, the primary wagering game includes two different bonus triggering outcomes and two different bonus games having different average expected payback percentages. In this example, the volatility determination system assigns each bonus triggering outcome with one of the bonus games based on the collected data. More specifically, the volatility determination system collects data in the form of hashtags from Twitter (as described above) and determines how many of the collected hashtags are associated with each of the bonus triggering outcomes. The volatility determination system assigns the bonus triggering outcome with which more of the collected Twitter hashtags are associated (i.e., that is more popular) with the bonus game having the higher average expected payback percentage, and assigns the bonus triggering outcome with which less of the collected Twitter hashtags are associated (i.e., that is less popular) with the bonus game having the lower average expected payback percentage.

In certain embodiments, instead of or in addition to employing the collected data to determine the paytables (i.e., the volatility data) for a primary wagering game, the volatility determination system uses the collected data in a similar manner to determine the paytables (i.e., the volatility data) for one or more bonus games.

In further embodiments, instead of or in addition to employing the collected data to determine the paytables (i.e., the volatility data) for a primary wagering game, the volatility determination system uses the collected data to determine which of a plurality of different quantities of tickets or tokens to provide when a ticket triggering event occurs in association with the primary wagering game. In one example, the primary wagering game includes two different ticket triggering outcomes and two different quantities of tickets. In this example, the volatility determination system assigns each ticket triggering outcome with one of the quantities of tickets based on the collected data. More specifically, the volatility determination system collects data in the form of hashtags from Twitter (as described above) and determines how many of the collected hashtags are associated with each of the ticket triggering outcomes. The volatility determination system assigns the ticket triggering outcome with which more of the collected Twitter hashtags are associated (i.e., that is more popular) with the greater quantity of tickets, and assigns the ticket triggering outcome with which less of the collected Twitter hashtags are associated (i.e., that is less popular) with the lower quantity of tickets.

In other embodiments, instead of or in addition to employing the collected data to determine the paytables (i.e., the volatility data) for a primary wagering game, the volatility determination system uses the collected data to determine how progressive award pools are funded. In one example, the primary wagering game is associated with a plurality of different progressive award pools, each of which is used to fund a different progressive award. In this example, the system allocates a portion of each wager placed on the primary wagering game to one of the progressive award pools. The volatility determination system determines to which of the progressive award pools to allocate the portion of the wager. More specifically, the volatility determination system collects data in the form of hashtags from Twitter (as described above) and determines how many of the collected hashtags are associated with each of the progressive award pools. The volatility determination system allocates the portion of the wager to the progressive award pool with which the highest percentage of the collected Twitter hashtags are associated (i.e., that is most popular).

In another example, the primary wagering game is associated with a plurality of different progressive award pools, each of which is used to fund a different progressive award. In this example, the system allocates a portion of each wager placed on the primary wagering game across the progressive award pools. The volatility determination system determines how much of the portion of the wager to allocate to each of the progressive award pools. More specifically, the volatility determination system collects data in the form of hashtags from Twitter (as described above) and determines how many of the collected hashtags are associated with each of the progressive award pools. The volatility determination system allocates more of the portion of the wager to the progressive award pool with which the highest percentage of the collected Twitter hashtags are associated (i.e., that is most popular) and less of the portion of the wager to the progressive award pool with which the lowest percentage of the collected Twitter hashtags are associated (i.e., that is the least popular).

In another example, the primary wagering game is associated with a single progressive award pool and a plurality of different progressive awards that are funded by the progressive award pool. In this example, the system allocates a portion of each wager placed on the primary wagering game to the progressive award pool, and increases a value of one or more of the progressive awards. The volatility determination system determines how much to increase one or more of the progressive awards. More specifically, the volatility determination system collects data in the form of hashtags from Twitter (as described above) and determines how many of the collected hashtags are associated with each of the progressive awards. The volatility determination system increases one or more of the progressive awards based on the popularity of those progressive awards (i.e., based on the percentage of the collected Twitter hashtags associated with the progressive awards) such that the more popular the progressive award, the more the volatility determination system increases the value of that progressive award.

In certain embodiments, instead of or in addition to employing the collected data to determine the paytables (i.e., the volatility data) for a primary wagering game, the volatility determination system uses the collected data in a similar manner to determine which symbols to employ for a play of the primary wagering game. In one example slot game, symbols associated with more popular search terms or keywords (e.g., Twitter hashtags) are more prevalent than symbols associated with less popular search terms or keywords (e.g., Twitter hashtags). In another example slot game, the volatility determination system determines the paytable (i.e., the volatility data) for a play of the slot game based on the two most popular search terms or keywords (e.g., Twitter hashtags), and determines the symbols for the play of the slot game based on the relative popularity of all of the search terms or keywords. In another example slot game, the volatility determination system replaces the symbols associated with a "losing" search term (such as a search term associated with a losing basketball team) with the symbols associated with a "winning" search term (such as a search term associated with a winning basketball team). Thus, as teams associated with the search terms "face off," associated symbols are added and removed according to the outcomes of the real-world games between those teams.

It should be appreciated that, in certain embodiments, the volatility determination system does not include a distinct data accumulator, a distinct external feed analyzer, and/or a distinct metric data analyzer.

FIG. 3 illustrates a flowchart of an example process or method 500 of operating the one such system of the present disclosure. In various embodiments, process 500 is represented by a set of instructions stored in one or more memories and executed by one or more processors. Although process 500 is described with reference to the flowchart shown in FIG. 3, it should be appreciated that many other processes of performing the acts associated with this illustrated process may be employed. For example, the order of certain of the illustrated blocks may be changed, certain of the illustrated blocks may be optional, and/or certain of the illustrated blocks may not be employed.

In this example, the system causes a volatility determination system to collect data from one or more external data feeds, as indicated by block 510. The system causes the volatility determination system to determine external feed data based on the collected data, as indicated by block 520. The system causes the volatility determination system to analyze the determined external feed data and determine metric data based on the analyzed external feed data, as indicated by block 530. The system causes the volatility determination system to analyze the determined metric data and determine volatility data representing the volatility of a game based on the analyzed metric data, as indicated by block 540. The system causes the volatility determination system to output the determined volatility data to a gaming system, as indicated by block 550.

The system causes the gaming system to receive the determined volatility data from the volatility determination system, as indicated by block 560. The system causes the gaming system to display a play of the game, wherein the game has the volatility represented by the received volatility data, as indicated by block 570. The system causes the gaming system to determine any awards associated with the play of the game, as indicated by block 580. The system causes the gaming system to display any determined awards, as indicated by block 590.

In certain embodiments, the gaming system includes or acts as the volatility determination system. That is, in such embodiments, the gaming system is configured to communicate with and collect data from the one or more external data feeds and use the collected data to determine the volatility of the game(s) playable on the gaming system.

In various embodiments, for a given game, the gaming system stores and/or is configured to access each potential paytable that may be employed for that game. In other words, in these embodiments, the gaming system stores a database of potential paytables that the gaming system may employ for the game. In these embodiments, the volatility determination system uses the collected data to determine which of the paytables in the database the gaming system should employ for at least one play of the game, and instructs the gaming system to employ that (those) paytable(s) for at least one play of the game.

In other embodiments, the gaming system includes or stores a plurality of different paytables associated with the primary wagering game, wherein the paytables each have different volatilities. In these embodiments, the volatility determination system uses the collected data to determine which of these paytables to cause the gaming system to employ for at least one play of the primary wagering game. For example, the primary wagering game is associated with a game having three different outcomes: Red, Green, and Blue. The gaming system stores three different paytables, a first of which includes a highest award associated with the Red outcome, a second of which includes the highest award associated with the Green outcome, and a third of which includes the highest award associated with the Blue outcome. In this example: (a) if the collected data includes more mentions associated with the Red outcome than the Green or the Blue outcome, the volatility determination system instructs the gaming system to employ the first paytable for at least one play of the primary wagering game; (b) if the collected data includes more mentions associated with the Green outcome than the Red or the Blue outcome, the volatility determination system instructs the gaming system to employ the second paytable for at least one play of the primary wagering game; and (c) if the collected data includes more mentions associated with the Blue outcome than the Red or the Green outcome, the volatility determination system instructs the gaming system to employ the third paytable for at least one play of the primary wagering game.

It should be appreciated that:

(a) the number of external data feeds;
(b) the external data feeds from which the volatility determination system collects data;
(c) the data collection period;
(d) how often the volatility determination system collects data from the external data feed(s) during the data collection period;
(e) the manner in which the specific external data feeds are selected;
(f) the primary wagering game;
(g) any bonus games;
(h) the average expected payback percentage of the primary wagering game;
(i) the probability of each winning outcome occurring;
(j) the format of the external feed data;
(k) the format of the metric data;
(l) the format of the volatility data;
(m) which data from the external data feeds is collected and/or is employed;
(n) the latency between the collection of data from the external data feeds and the use of that collected data (e.g., collected data must be used within a designated period of time (such as one hour, one day, one week, or one month));
(o) the manner in which data is collected (e.g., via polling, passive receipt, or a combination thereof); and/or
(p) any other suitable variable or determination disclosed herein, may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the primary wagering game and/or any bonus game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager; (17) determined independent of the player's primary game wager; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more weighted tables; (25) determined based on one or more other determinations disclosed herein; (26) determined independent of any other determination disclosed herein; (27) determined based on other external data feeds (e.g., determine which external data feeds from which to collect data based on which external data feeds are the most active or determine which symbols to use based on recent news); (28) determined independent of other external data feeds; and/or (29) determined in any other suitable manner or based on or independent of any other suitable factor(s).

Volatility Determination System

It should be appreciated that the embodiments of the volatility determination system described herein may be implemented in accordance with or in conjunction with one or more of a variety of different types of systems, such as, but not limited to, those described below.

The present disclosure contemplates a variety of different volatility determination systems each having one or more of a plurality of different features, attributes, or characteristics. It should be appreciated that a "volatility determination system" as used herein refers to various configurations of: (a) one or more central servers, central controllers, or remote hosts; and/or (b) one or more personal devices, such as desktop computers, laptop computers, tablet computers or computing devices, personal digital assistants (PDAs), mobile telephones such as smart phones, and other mobile computing devices.

Thus, in various embodiments, the volatility determination system of the present disclosure includes: (a) one or more personal devices in combination with one or more central servers, central controllers, or remote hosts; (b) a single personal device; (c) a plurality of personal devices in combination with one another; (d) a single central server, central controller, or remote host; and/or (e) a plurality of central servers, central controllers, or remote hosts in combination with one another.

For brevity and clarity, unless specifically stated otherwise, "personal device" as used herein represents one personal device or a plurality of personal devices, and "central server, central controller, or remote host" as used herein represents one central server, central controller, or remote host or a plurality of central servers, central controllers, or remote hosts.

As noted above, in various embodiments, the volatility determination system includes a personal device in combination with a central server, central controller, or remote host. In such embodiments, the personal device is configured to communicate with the central server, central controller, or remote host through a data network or remote communication link. In certain such embodiments, the personal device is configured to communicate with another personal device through the same data network or remote communication link or through a different data network or remote communication link.

In certain embodiments in which the volatility determination system includes a personal device in combination with a central server, central controller, or remote host, the central server, central controller, or remote host is any suitable computing device (such as a server) that includes at least one processor and at least one memory device or storage device. The personal device includes at least one personal device processor configured to transmit and receive data or signals representing events, messages, commands, or any other suitable information between the personal device and the central server, central controller, or remote host. The at least one processor of that personal device is configured to execute the events, messages, or commands represented by such data or signals in conjunction with the operation of the personal device. Moreover, the at least one processor of the central server, central controller, or remote host is configured to transmit and receive data or signals representing events, messages, commands, or any other suitable information between the central server, central controller, or remote host and the personal device. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the personal device. It should be further appreciated that one, more, or each of the functions of the at least one processor of the personal device may be performed by the at least one processor of the central server, central controller, or remote host.

In certain embodiments in which the gaming system includes: (a) a personal device configured to communicate with a central server, central controller, or remote host through a data network; and/or (b) a plurality of personal devices configured to communicate with one another through a data network, the data network is a local area network (LAN) in which the personal devices are located substantially proximate to one another and/or the central server, central controller, or remote host. In one example, the personal devices and the central server, central controller, or remote host are located in a gaming establishment or a portion of a gaming establishment.

In other embodiments in which the gaming system includes: (a) a personal device configured to communicate with a central server, central controller, or remote host through a data network; and/or (b) a plurality of personal devices configured to communicate with one another through a data network, the data network is a wide area network (WAN) in which one or more of the personal devices are not necessarily located substantially proximate to another one of the personal devices and/or the central server, central controller, or remote host. It should be appreciated that volatility determination systems in which the data network is a WAN are substantially identical to volatility determination systems in which the data network is a LAN, though the quantity of personal devices in such volatility determination systems may vary relative to one another.

In further embodiments in which the volatility determination system includes: (a) a personal device configured to communicate with a central server, central controller, or remote host through a data network; and/or (b) a plurality of personal devices configured to communicate with one another through a data network, the data network is an internet or an intranet.

It should be appreciated that the central server, central controller, or remote host and the personal device are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
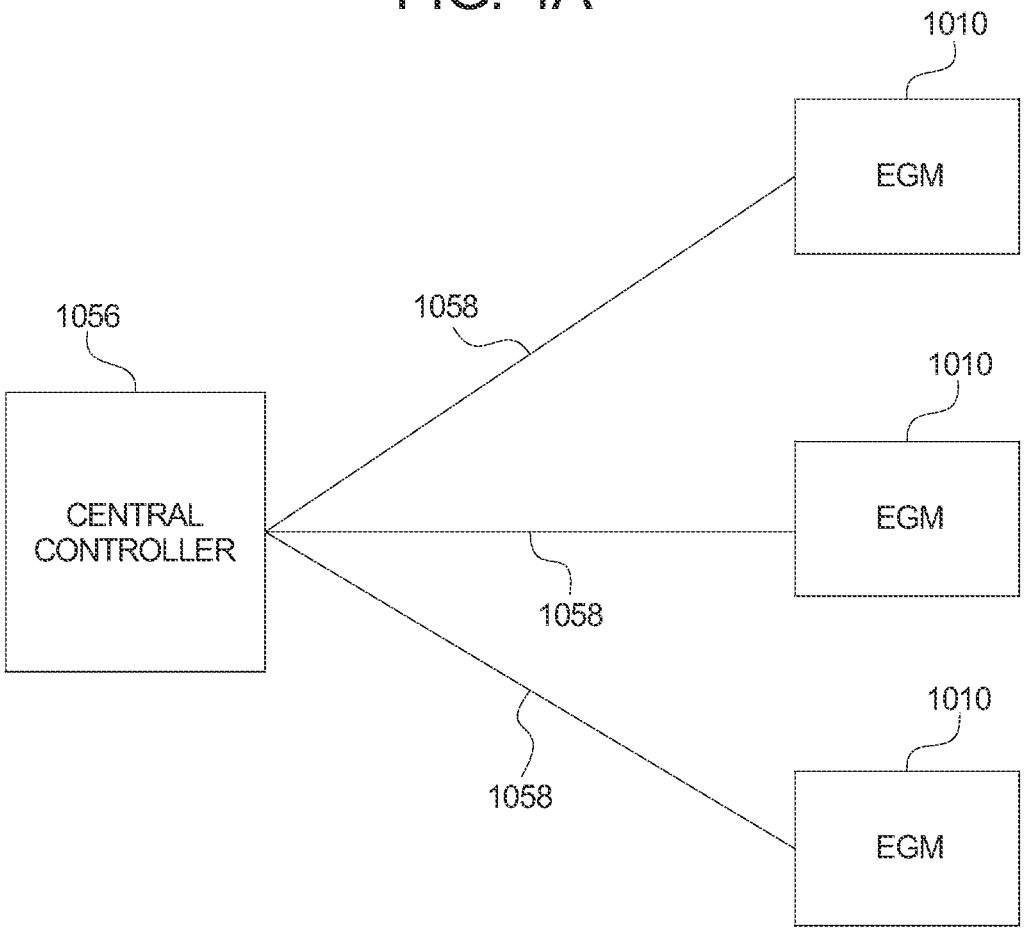
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
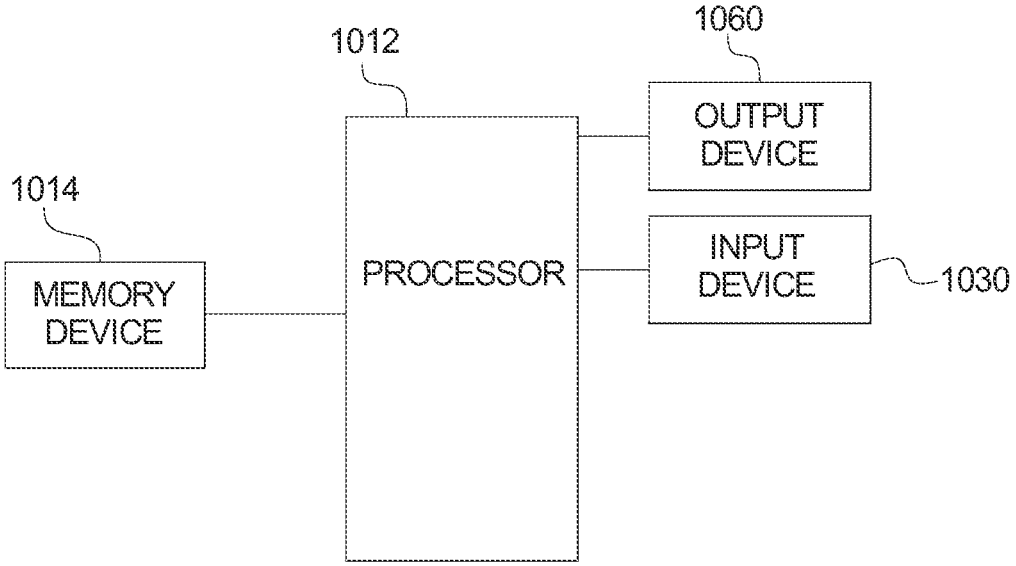
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
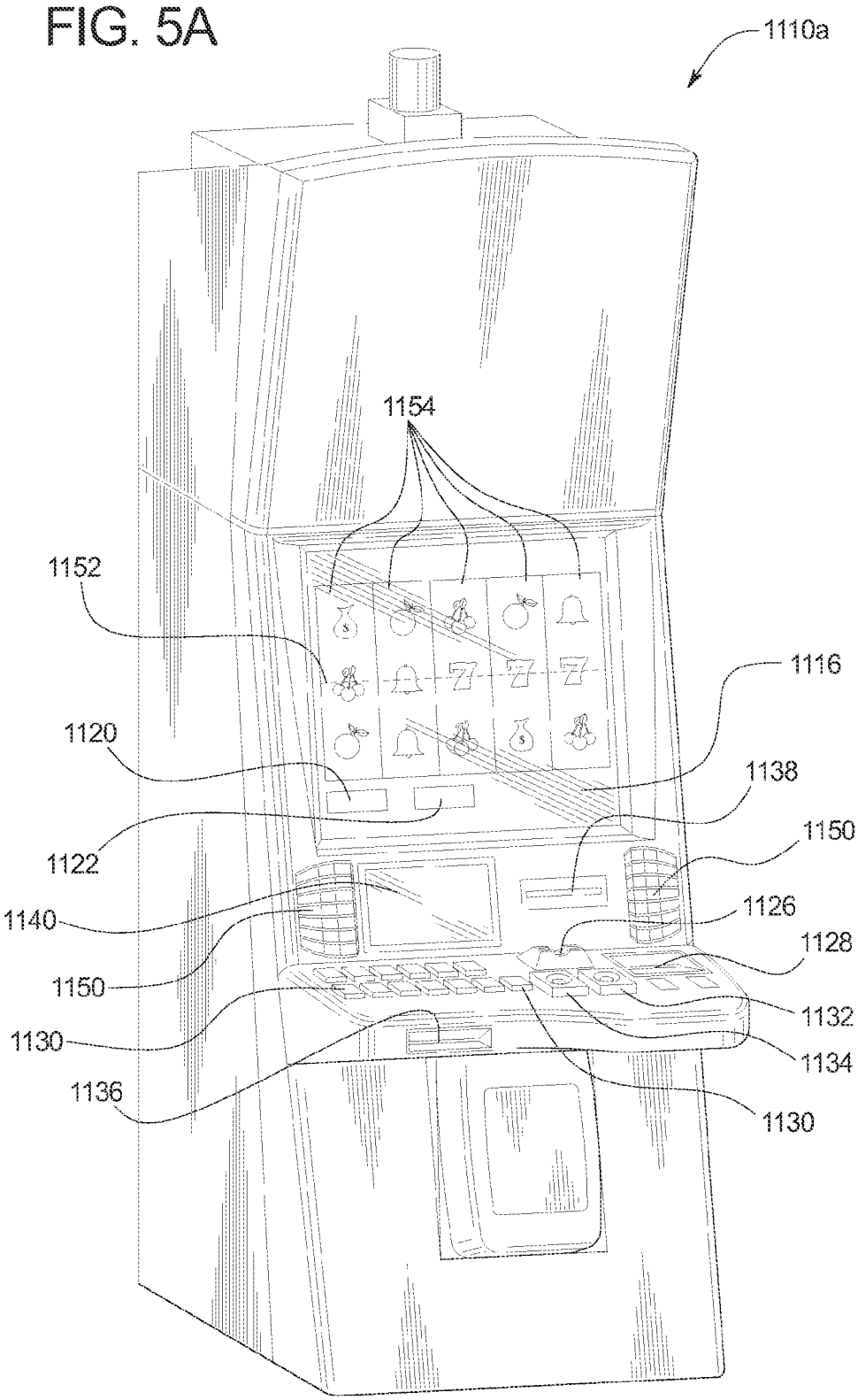
FIGS. 5A and 5B are perspective views of example alternative embodiments of the gaming system of the present disclosure.
Figure 5B:
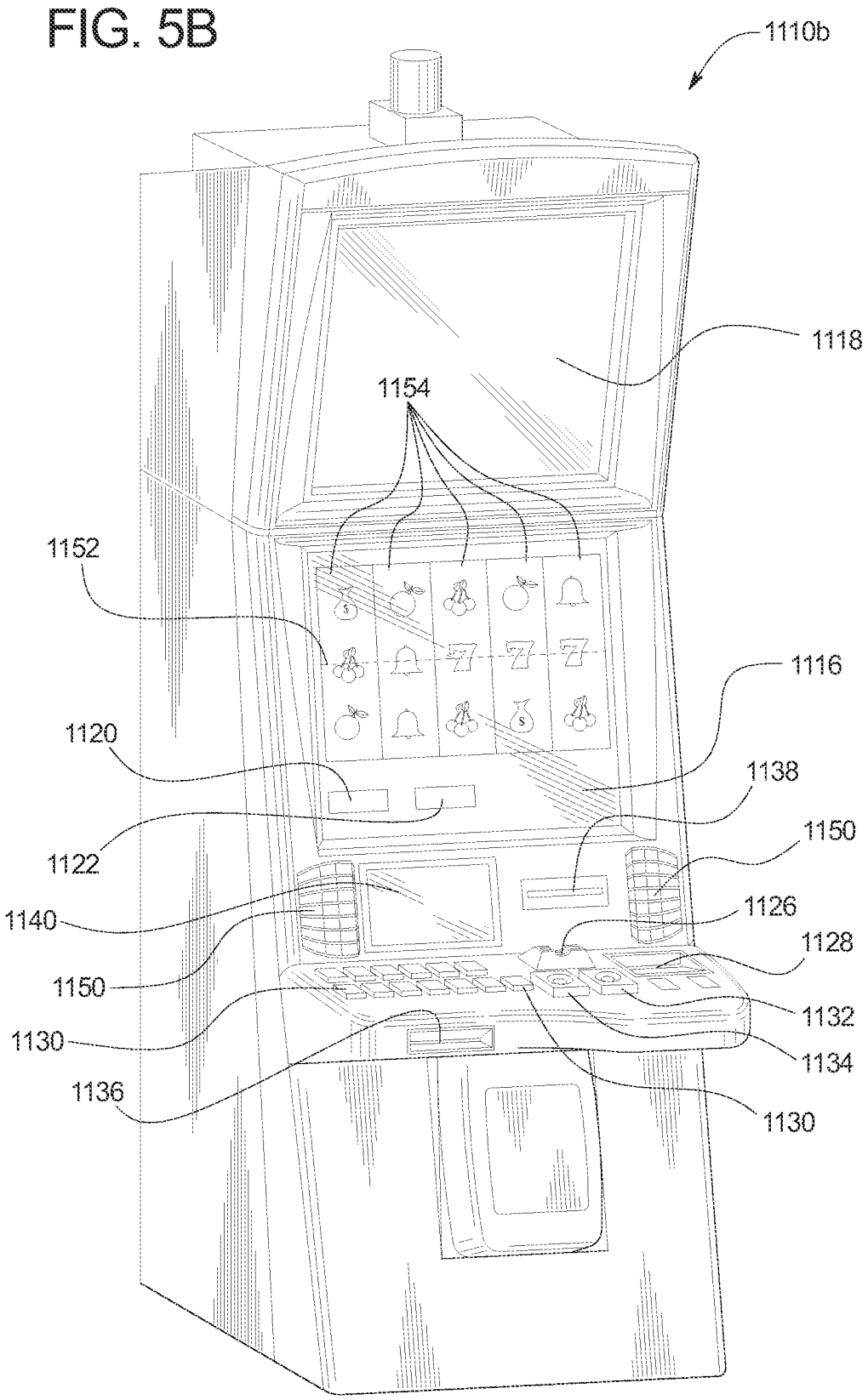

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follow:

1. A system comprising:

a volatility determination system configured to:

(a) collect data from one or more external data feeds, said external data feeds being selected from the group consisting of: at least one of a plurality of social networking websites, at least one of a plurality of news services, at least one of a plurality of internet search engines, at least one of a plurality of databases of sporting event scores, at least one of a plurality of weather databases, at least one of a plurality of rich site summary feeds, a stock market, a futures exchange, a foreign exchange market, and at least one of a plurality of message board websites;

(b) determine external feed data based on the collected data, said external feed data being separate from any data collected in association with any plays of any wagering games and said external feed data being separate from any player tracking data collected in association with any plays of any wagering games by any players;

(c) analyze the determined external feed data for any uses of any of a plurality of different terms;

(d) determine metric data based on the analyzed external feed data, the metric data in part representing how often a first one of the plurality of terms is used in the external feed data relative to how often each of one or more other terms of the plurality of terms are used in the external feed data;

(e) analyze the determined metric data;

(f) determine volatility data based on the analyzed metric data; and (g) output the determined volatility data; and a gaming system comprising:

at least one processor;

at least one display device;

at least one input device; and at least one memory device storing a plurality of instructions which, when executed by the at least one processor, cause the at least one processor to operate with the at least one display device to:

(i) receive the determined volatility data from the volatility determination system;

(ii) display a play of a wagering game, wherein said wagering game has a volatility which is determined, at least in part, based on the received determined volatility data such that if first determined volatility data based on first external feed data is received from the volatility determination system, a first play of the wagering game at a first wager amount is associated with a first wagering game volatility and if second, different determined volatility data based on second, different external feed data is received from the volatility determination system, a second play of the wagering game at the first wager amount is associated with a second, different wagering game volatility;

(iii) determine any awards associated with said play of the wagering game; and (iv) display any determined awards.

2. The system of claim 1, wherein the volatility determination system includes a separate data accumulator, a separate external feed data analyzer, and a separate metric data analyzer, and wherein:

(a) the data accumulator is configured to collect the data from the one or more external data feeds, determine the external feed data based on the collected data, and output the determined external feed data to the external feed data analyzer;

(b) the external feed data analyzer is configured to receive the determined external feed data from the data accumulator, analyze the received external feed data, determine the metric data based on the analyzed external feed data, and output the determined metric data to the metric data analyzer; and (c) the metric data analyzer is configured to receive the determined metric data from the external feed data analyzer, analyze the received metric data, determine the volatility data based on the analyzed metric data, and output the determined volatility data to the gaming system.

3. The system of claim 1, wherein the determined volatility data includes one or more paytables.

4. The system of claim 3, wherein one of a plurality of different wager amounts are wagerable on the wagering game, and the one or more paytables included in the determined volatility data include a paytable for each of the plurality of different wager amounts.

5. The system of claim 3, wherein each of the paytables includes one or more winning outcomes each associated with an award, and, for each of the paytables, for each of the one or more winning outcomes of said paytable, the volatility determination system is configured to determine the award with which to associate said winning outcome based on the collected data.

6. The system of claim 1, wherein the volatility determination system is configured to collect the data from the one or more external data feeds via a data network.

7. The system of claim 6, wherein the data network is an internet.

8. The system of claim 1, wherein the volatility determination system is configured to collect the data from the one or more external data feeds during a data collection period.

9. The system of claim 1, which is not configured to modify an average expected payback percentage of the wagering game.

10. A method comprising:

(a) collecting, by a volatility determination system, data from one or more external data feeds, said external data feeds being selected from the group consisting of: at least one of a plurality of social networking websites, at least one of a plurality of news services, at least one of a plurality of internet search engines, at least one of a plurality of databases of sporting event scores, at least one of a plurality of weather databases, at least one of a plurality of rich site summary feeds, a stock market, a futures exchange, a foreign exchange market, and at least one of a plurality of message board websites;

(b) determining, by the volatility determination system, external feed data based on the collected data, said external feed data being separate from any data collected in association with any plays of any wagering games and said external feed data being separate from any player tracking data collected in association with any plays of any wagering games by any players;

(c) analyzing, by the volatility determination system, the determined external feed data for any uses of any of a plurality of different terms;

(d) determining, by the volatility determination system metric data based on the analyzed external feed data, the metric data in part representing how often a first one of the plurality of terms is used in the external feed data relative to how often each of one or more other terms of the plurality of terms are used in the external feed data;

(e) analyzing, by the volatility determination system, the determined metric data;

(f) determining, by the volatility determination system, volatility data based on the analyzed metric data;

(g) outputting, by the volatility determination system, the determined volatility data;

(h) receiving, by at least one gaming system processor, the determined volatility data from the volatility determination system;

(i) displaying, by at least one display device of the gaming system, a play of a wagering game, wherein said wagering game has a volatility which is determined, at least in part, based on the determined volatility data such that if first determined volatility data based on first external feed data is received from the volatility determination system, a first play of the wagering game at a first wager amount is associated with a first wagering game volatility and if second, different determined volatility data based on second, different external feed data is received from the volatility determination system, a second play of the wagering game at the first wager amount is associated with a second, different wagering game volatility;

(j) determining, by the at least one gaming system processor, any awards associated with said play of the wagering game; and (k) displaying, by the at least one display device, any determined awards.

11. The method of claim 10, wherein the volatility determination system includes a separate data accumulator, a separate external feed data analyzer, and a separate metric data analyzer, and which includes:

(a) collecting, by the data accumulator, the data from the one or more external data feeds; determining, by the data accumulator, the external feed data based on the collected data; and outputting, by the data accumulator, the determined external feed data to the external feed data analyzer;

(b) receiving, by the external feed data analyzer, the determined external feed data from the data accumulator; analyzing, by the external feed data analyzer, the received external feed data; determining, by the external feed data analyzer, the metric data based on the analyzed external feed data; and outputting, by the external feed data analyzer, the determined metric data to the metric data analyzer; and (c) receiving, by the metric data analyzer, the determined metric data from the external feed data analyzer; analyzing, by the metric data analyzer, the received metric data; determining, by the metric data analyzer, the volatility data based on the analyzed metric data; and outputting, by the metric data analyzer, the determined volatility data to the gaming system.

12. The method of claim 10, wherein the determined volatility data includes one or more paytables.

13. The method of claim 12, wherein one of a plurality of different wager amounts are wagerable on the wagering game, and the one or more paytables included in the determined volatility data include a paytable for each of the plurality of different wager amounts.

14. The method of claim 12, wherein each of the paytables includes one or more winning outcomes each associated with an award, and which includes, for each of the paytables, for each of the one or more winning outcomes of said paytable, determining, by the volatility determination system, the award with which to associate said winning outcome based on the collected data.

15. The method of claim 10, which includes collecting, by the volatility determination system, the data from the one or more external data feeds via a data network.

16. The method of claim 15, wherein the data network is an internet.

17. The method of claim 10, which includes collecting, by the volatility determination system, the data from the one or more external data feeds during a data collection period.

18. The method of claim 10, which includes not modifying an average expected payback percentage of the wagering game.

19. The method of claim 10, which includes receiving, by the at least one gaming system processor, the determined volatility data from the volatility determination system via a data network.

20. The method of claim 19, wherein the data network is an internet.

21. The system of claim 1, wherein the gaming system includes a housing and a plurality of input devices supported by the housing, said plurality of input devices including (i) an acceptor, and (ii) a cashout device, and wherein when executed by the at least one processor, the plurality of instructions cause the at least one processor to operate with the plurality of input devices to: responsive to receipt of a physical item via the acceptor, establish a credit balance based at least in part on a monetary value associated with the received physical item, and responsive to a cashout input received via the cashout device, cause an initiation of any payout associated with the credit balance.

22. The method of claim 10, wherein any determined awards cause an increase of a credit balance which is increasable via an acceptor of a physical item associated with a monetary value, and decreasable via a cashout device configured to receive an input to cause an initiation of a payout associated with the credit balance.

* * * * *